US005811919A

United States Patent [19]

Hoogsteen et al.

[11] Patent Number: 5,811,919

[45] Date of Patent: Sep. 22, 1998

[54] THIN-PANEL PICTURE DISPLAY DEVICE

[75] Inventors: Willem Hoogsteen; Ronaldus M. H. Steyvers; Monica Scholten; Maria C. Van Uden, all of Eindhoven, Netherlands

[73] Assignee: U.S. Philips Corporation, New York, N.Y.

[21] Appl. No.: 502,691

[22] Filed: Jul. 14, 1995

[30] Foreign Application Priority Data

Jul. 18, 1994 [EP] European Pat. Off. ..... 94202082

[51] Int. Cl.[6] ..... H01J 29/70

[52] U.S. Cl. ..... 313/422; 313/103 CM; 313/105 CM

[58] Field of Search ..... 345/74, 75; 313/489, 313/422, 495, 496, 105 CM, 106, 107, 103 CM, 479

[56] References Cited

U.S. PATENT DOCUMENTS

| | | | |
|---|---|---|---|
| 3,885,190 | 5/1975 | Taniguchi | 313/402 |
| 4,442,376 | 4/1984 | Van Der Waal | 313/402 |
| 5,313,136 | 5/1994 | Van Gorkom et al. . | |
| 5,442,253 | 8/1995 | Van Gorkom | 313/422 |

FOREIGN PATENT DOCUMENTS

| | | | |
|---|---|---|---|
| 0464937 | 6/1991 | European Pat. Off. . | |
| 0580244A1 | 1/1994 | European Pat. Off. | H01J 29/82 |

*Primary Examiner*—Sandra L. O'Shea
*Assistant Examiner*—Vip Patel
*Attorney, Agent, or Firm*—Robert J. Kraus

[57] ABSTRACT

A thin-panel picture display device having a luminescent screen is provided and by means of an addressing system, electrons are directed towards desired locations on the luminescent screen. A spacer plate of electrically insulating material, with apertures for passing electrons, is present between the addressing system and the screen. To provide the possibility of applying voltage differences of at least 5 kV across the thickness of the spacer plate, at least the walls of the apertures are coated with a coating of particles of nitrides, borides, carbides, oxides of chromium, yttrium, tantalum, with a secondary emission coefficient of $\delta_{max} \leqq 3.5$ and an electrical sheet resistance of at least $10^{12}$ Ω/□.

15 Claims, 3 Drawing Sheets

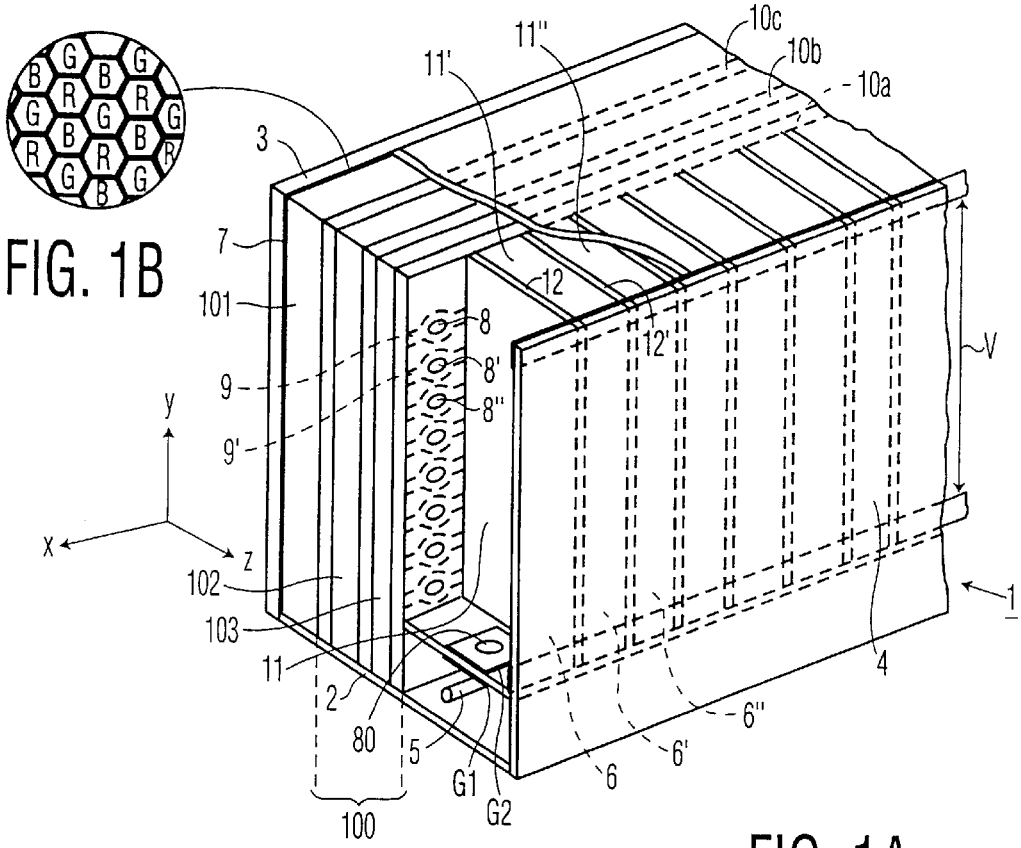
FIG. 1B
FIG. 1A
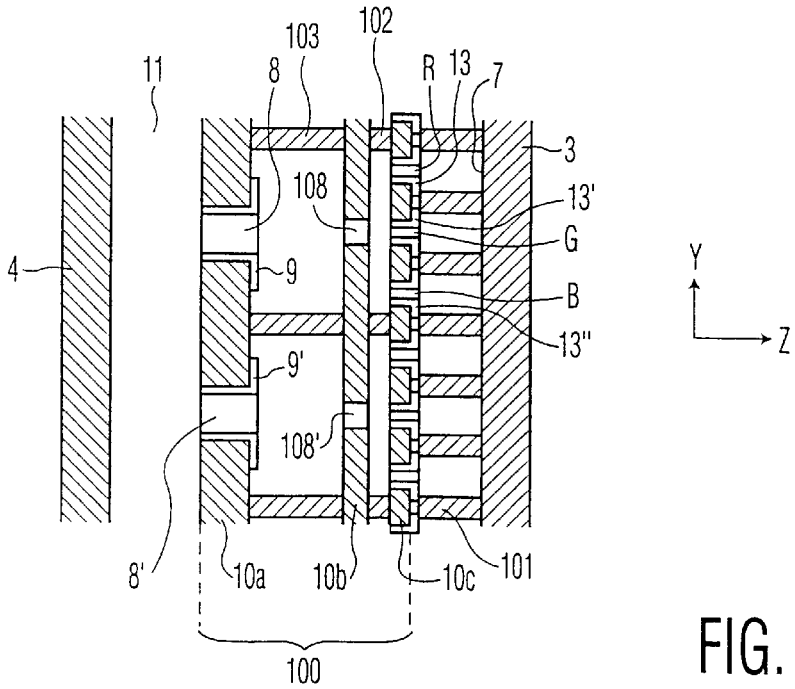
FIG. 2

THIN-PANEL PICTURE DISPLAY DEVICE

The invention relates to a picture display device having a vacuum envelope which is provided with a transparent face plate and a display screen having a pattern of luminescent pixels, and with a rear wall, comprising electron producer means, an addressing system arranged between the electron producer and the face plate so as to address desired pixels, and, adjacent to the display screen, an apertured spacer plate of electrically insulating material for passing electrons.

The display device described above is of the thin-panel type. Display devices of the thin-panel type are devices having a transparent face plate and, arranged at a small distance therefrom, a rear plate, while a (for example, hexagonal) pattern of phosphor dots is provided on the inner surface of a face plate. If (video information-controlled) electrons impinge upon the luminescent screen, a visual image is formed which is visible via the front side of the face plate. The face plate may be flat or, if desired, curved (for example spherical or cylindrical).

BACKGROUND AND SUMMARY OF THE INVENTION

A thin-panel display device described in U.S. Pat. No. 5,313,136 comprises a plurality of juxtaposed sources for emitting electrons, local electron propagation means cooperating with the sources, each having a wall of a high-ohmic, electrically substantially insulating material having a secondary emission coefficient which is suitable for propagating emitted electrons, and an addressing system comprising electrodes (selection electrodes) which can be driven row by row so as to extract electrons from the propagation means at predetermined extraction locations facing the luminescent screen, while further means are provided for directing extracted electrons towards pixels of the luminescent screen for producing a picture composed of pixels.

Other display devices of the thin-panel type are, for example plasma displays and field emission displays.

The luminescent screen is also referred to as the phosphor screen. An important component of the above-mentioned display device is the screen spacer.

The screen spacer is adjacent to the phosphor screen. Due to the efficiency and the saturation behaviour of the phosphor, it is of crucial importance that the acceleration voltage to the phosphor screen be as high as possible. Depending on the phosphors used, 3 kV or, more frequently, 4 to 5 kV is a minimum requirement.

The screen spacer is made of an insulating material, particularly glass. The face plate is provided with a low-ohmic transparent conducting electrode of, for example ITO. This coating is provided with the phosphor screen and (possibly) a black matrix. A typical thickness of the screen spacer is 0.3 or 0.4 to 1.0 mm. The voltage difference between the input side of the screen spacer and the ITO coating should be as high as possible. At large voltage differences a number of unwanted effects in the form of picture errors may occur. The invention is based on the recognition that these effects are related to the "vacuum current" flowing through the screen spacer. The invention provides a display device of the type described in the opening paragraph, whose surfaces, particularly of the aperture walls, of the screen spacer are treated in such a way that the occurrence of these unwanted effects (which, according to the invention, are based on secondary emission of electrons backscattered from the display screen at voltage differences of at least 5 kV across the spacer) are obviated entirely or partly. For this purpose, a coating is preferably used which has such a composition that its properties are stable under electron bombardment. This contributes to the lifetime.

To this end, an embodiment of a display device of the type described in the opening paragraph is characterized in that the walls of the apertures in the spacer plate are coated with a coating selected from the group consisting of nitrides, borides, carbides, oxides of yttrium, chromium, tantalum. Nitrides etc. are also understood to mean oxy-nitrides etc.

It has been found that unwanted field emission may occur upon electron charging due to transport of electrons through the apertures of the spacer ("the vacuum current"). To prevent this, a coating having a low "$\delta_{max}$" (low maximum secondary emission coefficient) may be provided on the walls of the apertures and possibly also on the surface of the spacer plate. It has been found that particularly a coating comprising a nitride, an oxy-nitride and/or a metal oxide yields $\delta_{max}$ values of $\leqq 3.5$ and particularly less than 3, in combination with electrical resistances of more than $10^{12}$ $\Omega/\square$ and particularly larger than $10^{13}$ $\Omega/\square$, which values are eminently suitable for the purpose of the invention.

Silicon nitride, aluminium nitride, chromium oxide and yttrium oxide have been found to be particularly suitable because they appear to have an extra high stability (particularly of the electrical resistance) during electron bombardment occurring in a display, as compared with other materials satisfying the resistance and $\delta_{max}$ requirements such as $Ta_2O_5$. Silicon nitride and aluminium nitride may have a stoichiometric composition ($Si_3N_4$ and AIN, respectively, but this is not necessary. It appears that at higher acceleration voltages, the unwanted effects leading to picture errors cannot always be prevented completely when these measures are used. It is found that the resistance of the spacer material should be sufficiently high. This resistance R (in $\Omega$cm) preferably satisfies $\log R \geqq 12$.

The required coatings may be provided by means of plasma CVD or (rf or dc) magnetron sputtering. Generally, the surface of the plate and the walls of the apertures are coated therewith, while leaving the choice of coating at one or two sides. Generally, the coating of the walls of the apertures appears to be thinner than that of the plate surfaces.

Sputtering and vapour deposition lead to homogeneous coatings. To obtain a coating having a minimum $\delta$, it appears to be efficient to provide a particle coating (a "granular", or rough, coating) instead of a homogeneous coating. Preferably, the particles of the coating have dimensions in the micron or sub-micron range. Within the scope of the invention, such particle coatings can be provided in a relatively simple manner by spraying a suspension comprising the particles. (During spraying, drops are atomized.) Surprisingly, a satisfactory wall coating of the apertures can be realised during spraying of a suspension across the plate surface: after drying, a particle coating is left. Alternatively, dipping and curtain spraying (at which the plate surface is moved under a falling curtain of liquid) appear to lead to acceptable particle coatings on the walls of the apertures.

Alternatively, the desired particles can be provided on the walls of the apertures by means of a phototacky process.

These and other aspects of the invention will be apparent from and elucidated with reference to the embodiments described hereinafter.

BRIEF DESCRIPTION OF THE DRAWINGS FIGURES

In the drawings:

FIG. 1 is a diagrammatic perspective elevational view, partly broken away, of a part of a (colour) display device with electron propagation ducts, an addressing system with an apertured preselection plate, an apertured fine-selection plate and a screen spacer whose components are not shown to scale;

FIG. 2 is a diagrammatic cross-section through a part of a device of the type shown in FIG. 1;

Identical components are denoted by the same reference numerals.

DESCRIPTION OF THE INVENTION AND EMBODIMENTS

Figure 3:
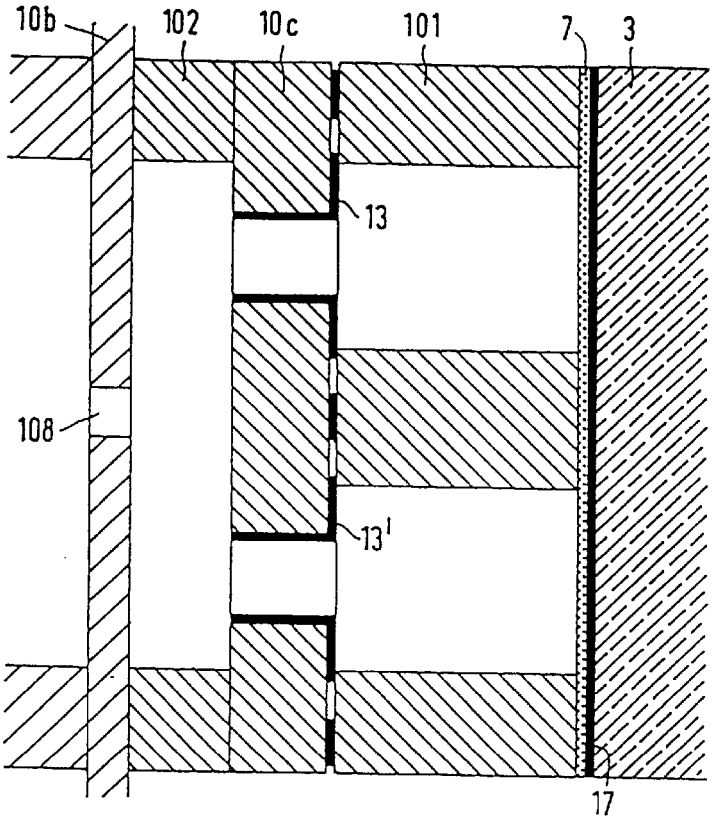
FIG. 3 shows a larger detail of FIG. 2.

FIG. 1 shows a thin-panel picture display device of the type described in EP-A 464937 having a display panel (window) 3 and a rear wall 4 located opposite panel 3. A display screen 7 having a (for example, hexagonal) pattern of red (R), green (G) and blue (B) luminescing phosphor pixels is arranged on the inner surface of window 3. In the embodiment shown triplets of phosphor elements are arranged in tracks transverse to the long axis of the display screen (i.e. "vertically staggered", see inset) but the invention is not limited thereto. For example, a horizontally staggered arrangement is also possible.

An electron source arrangement 5, for example a line cathode which by means of electrodes provides a large number of electron emitters, for example 600, or a similar number of separate emitters, is arranged proximate to a wall 2 which interconnects panel 3 and rear wall 4. Each of these emitters provide a relatively small current so that many types of cathodes (cold or hot cathodes) are suitable as emitters. The emitters may be driven by a video drive circuit. The electron source arrangement 5 is arranged opposite entrance apertures of a row of electron propagation ducts extending substantially parallel to the screen, which ducts are constituted by compartments 6, 6', 6", . . . etc., in this case one compartment for each electron source. These compartments have cavities 11, 11', 11", . . . defined by the rear wall 4 and partitions 12, 12' . . . . The cavities 11, 11', . . . may alternatively be provided in the rear wall 4 itself. At least one wall (preferably the rear wall) of each compartment should have a high electrical resistance in at least the propagation direction, which resistance is suitable for the purpose of the invention, and have a secondary emission coefficient δ>1 over a given range of primary electron energies (suitable materials are, for example, ceramic material, glass, synthetic material-coated or uncoated). An axial propagation field is generated in the compartments by applying a potential difference $V_p$ across the height of the compartments 6, 6', 6", . . . .

The electrical resistance of the wall material has such a value that a minimum possible total amount of current (preferably less than, for example 10 mA) will flow in the walls at a field strength in the axial direction in the compartments of the order of one hundred to several hundred volts per cm required for the electron propagation. By applying a voltage of the order of several dozen to several hundred volts (value of the voltage is dependent on circumstances) between the row 5 of electron sources and the compartments 6, 6', 6", electrons are accelerated from the electron sources towards the compartments, whereafter they impinge upon the walls in the compartments and generate secondary electrons.

The space between the compartments and the luminescent screen 7, which is arranged on the inner wall of panel 3, accommodates in this case a (stepped) addressing system 100 which comprises an (active) preselection plate 10*a*, a (passive) obstruction plate 10*b* and an (active) (fine-) selection plate 10*c* (see also FIG. 2). Structure 100 is separated from the luminescent screen 7 by a screen spacer 101 formed as an apertured plate of electrically insulating material.

FIG. 2 shows in a diagrammatical cross-section a part of the display device of FIG. 1 in greater detail, particularly the addressing structure 100 comprising preselection plate 10*a* with apertures 8, 8', 8", . . . , and fine-selection plate 10*b* with groups of apertures R, G, B. Three fine-selection apertures R, G, B are associated with each preselection aperture 8, 8', etc. in this case. In the diagrammatic FIG. 2, the apertures R, G, B are coplanar. However, in reality they are arranged in a configuration corresponding to the phosphor dot pattern (see FIG. 1). In this case, an apertured obstruction plate 10*b* having apertures 108, 108", . . . is arranged between the preselection plate 10*a* and the fine-selection plate 10*c*, which obstruction plate prevents electrons from the propagation ducts 11 from impinging upon the display screen straight through a fine-selection aperture (known as unwanted "direct hits").

Electron propagation ducts 6 with transport cavities 11, 11', . . . are formed between the structure 100 and rear wall 4. To be able to extract electrons from the ducts 6 via the apertures 8, 8', . . . , addressable, metal preselection electrodes 9, 9', etc. extending from aperture to aperture and surrounding the apertures are arranged in ("horizontal") rows parallel to the long axis of the display screen on, for example the display screen side of the plate 10*a*.

The walls of the apertures 8, 8', . . . may be metallized.

Similarly, as the plate 10*a*, the fine-selection plate 10*c* is provided with "horizontally oriented" addressable rows of (fine-)selection electrodes for realizing fine selection. The possibility of directly or capacitively interconnecting corresponding rows of fine-selection electrodes is important in this respect. In fact, a preselection has already taken place and, in principle, electrons cannot land at the wrong location. This means that only one group, or a small number of groups of three separately formed fine-selection electrodes is required for this mode of fine selection.

The preselection electrodes 9, 9', . . . are subjected to a linearly increasing DC voltage, for example by connecting them to a voltage divider. The voltage divider is connected to a voltage source in such a way that the correct potential distribution to realize electron transport in the ducts is produced across the length of the propagation ducts. Driving is effected, for example by applying a pulse (of, for example 250 V) for a short period of time to consecutive preselection electrodes and to apply shorter lasting pulses of, for example 200 V to the desired fine-selection electrodes. It should of course be ensured that the line selection pulses are synchronized with the video information. The video information is applied, for example to the individual $G_1$ electrodes which drive the emitters (FIG. 1), for example in the form of a time or amplitude-modulated signal.

It should be noted that several variants of the construction comprising the obstruction plate 10*b* as shown in FIG. 2 are possible. For example, the plate 10*b* may be combined to one unit with one or both spacer plates 102, 103 at both sides. In this case, the spacer plate 103 is referred to as the coarse-selection spacer and spacer plate 102 is referred to as the obstruction plate spacer or "chicane" spacer.

Figure 4:
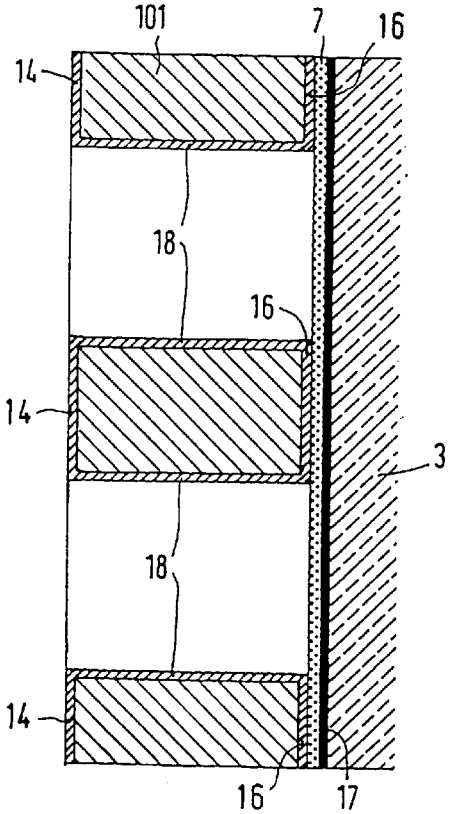
FIG. 4 is a cross-sectional view of an embodiment of a screen spacer.

When electrons are passed through the apertures in the fine-selection electrode 13, 13', 13" . . . , the walls of the screen spacer will be charged. This charging is mainly effected by electrons which are backscattered from the phosphor screen and generate secondary electrons on the spacer walls, which electrons in their turn are transported to the phosphor screen. It appears to be favourable to ensure that the walls of the screen spacer apertures are poor secondary emitters, by providing a coating 18 having a secondary emission coefficient $\delta_{max}$ which is smaller than that of glass. In practice, coatings of $1 \leqq \delta_{max} \leqq 3.5$ are suitable and particularly $\delta_{max} \leqq 3$. Of the materials having a satisfactory resistance against electron bombardment, for example aluminium nitride has $\delta_{max}$ values in the higher part of this range, silicon nitride has $\delta_{max}$ values in the central part and $Y_2O_3$ has $\delta_{max}$ values in the lower part. Said coating should have a sufficiently high-ohmic value so that the fine-selection side of the screen spacer is not "short-circuited" with the screen side. FIG. 4 shows where the coatings may be present. The material for the "low δ" coating 18 of the aperture walls may be provided on the entire spacer 101, for example as coatings 14 and/or 16 on the facing sides; in practice this is often simpler than providing the coatings on the aperture walls only. Low δ coatings may be provided by means of many techniques. The drawback of vacuum techniques such as vapour deposition and sputtering is that these are expensive processes. Moreover, it is particularly important for the low δ coating that the walls of the apertures are correctly covered. This is difficult to realise in the vapour deposition and sputtering processes. Wet-chemical processes are often relatively inexpensive, rapid and suitable for coating three-dimensional structures. Wet-chemical processes also comprise a number of different methods of providing low δ coatings. Use can be made of precursors which are provided on the substrate by means of techniques such as dipping or aerosol spraying. Subsequently, these precursors should be chemically converted into the desired material. In most cases, all the above-mentioned techniques yield fairly thin, homogeneous coatings. When spraying a suspension, relatively thick, rough particle coatings are formed. Particle coatings may also be provided by means of a "phototacky" process.

a) Low δ silicon nitride coatings A suitable way of making silicon nitride coatings (other than by sputtering or vapour deposition) appears to be the provision of particle coatings by means of spraying. Such coatings had a $\delta_{max}$ of between 2.2 and 2.8 and a resistance of at least $5 \times 10^{13}$ Ω/□.

b) Low δ aluminium nitride coatings

Sputtered aluminium nitride coatings had a resistance of approximately $10^{13}$ Ω/□ and a $\delta_{max}$ of approximately 3.3. For sprayed AIN coatings, resistances in the range between $10^{13}$ and $10^{15}$ Ω/□ and $\delta_{max}$ values of approximately 3 were found.

c) Low δ $Y_2O_3$ coatings $Y_2O_3$ particle coatings yield a $\delta_{max}$ of less than 2, which is smaller than the $\delta_{max}$ of sputtered and vapour-deposited coatings and coatings made by means of a Y precursor. Moreover, in contrast to Y precursors (often used in an alcoholic medium) an aqueous medium can be used. Resistances of $\geqq 10^{14}$ Ω/□ were found.

Embodiment 1

Figure 5:
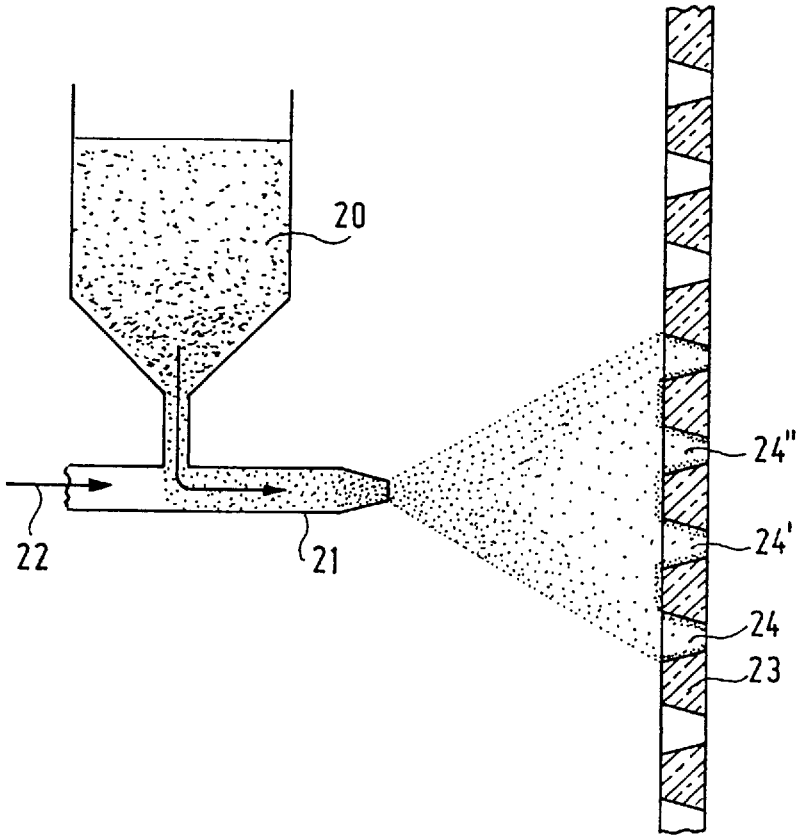
FIG. 5 shows diagrammatically the provision of a low-δ particle coating on screen spacer plate.

The (sub-)micron low δ particles were suspended in water and, if necessary, the suspension (20, FIG. 5) was stabilized with a stabilizer (such as, for example a polymer or water glass). Moisteners and agents improving the adhesion may be added. Water glass—sodium silicate—is a possibility, but $Y_2O_3$, $CrO_x$ or MgO may alternatively be used to improve particularly the adhesion of nitrides, etc.

Subsequently, the suspension was introduced into a spray gun and atomized by means of a nozzle 21 and compressed air (22). The atomized suspension coats the substrate to be coated (glass plate 23 with apertures 24, 24', 24" . . . ). After evaporation of the solvent, a particle coating was left on the substrate. After possible firing of the polymer used, a particle coating of the desired δ was obtained.

Instead of water, other organic solvents, for example alcohols may be used.

Homogeneous coatings having a thickness of between one or several microns and approximately ten microns can be provided by means of spraying with particles having sizes of several tenths of microns to one or several microns. The thickness of the coating on the plate surface may be, for example between approximately three and ten microns and, for example between one and three microns on the walls of the apertures.

The advantages of providing a low a particle coating by means of suspension spraying are:

it is a rapid and inexpensive process which can be carried out in an aqueous medium. Surprisingly, it appears to be suitable for coating three-dimensional structures (walls of apertures). Moreover, the roughness of the coating may have a positive effect on the δ value: the particle coatings examined yielded a lower δ than homogeneous layers of the same composition.

Embodiment 2

A surface part of a screen spacer of 5×5 cm was coated with a PT layer by pouring a phototacky (PT) solution. After drying for about 20 sec., the spacer was illuminated at both sides (for about 30 sec.) on a CMT illumination table (illumination distance about 10 cm). Subsequently, $Si_3N_4$ powder (0.3 μm) was contacted with the layer which had become tacky due to the illumination. After the excess powder had been blown off, the spacer was fired in air at 440° C. The coating was satisfactory, also in the apertures. The experiment was repeated with a glass plate which had been pre-rinsed in extran. A 5% PT solution was used. The powder was applied by means of a brush. The resultant average layer thickness was 2,5 μm and the coating in the apertures was satisfactory. The latter experiment was repeated with a silicon wafer. In this experiment, the illumination time was extended so as to study the influence on roughness.

| | Illumination time | |
|---|---|---|
| | 1 minute | 3 minutes |
| layer thickness | 3.7 μm | 5.1 μm |
| roughness | 0.25 μm | 0.67μm |

In summary, the invention particularly relates to a thin-panel picture display device having a luminescent screen.

By means of an addressing system, electrons are directed towards desired locations on the luminescent screen. A spacer plate of electrically insulating material, with apertures for passing electrons, is present between the addressing system and the screen. To provide the possibility of applying voltage differences of at least 5 kV across the thickness of the spacer plate, at least the walls of the apertures are coated with a coating of particles of nitrides, borides, carbides, oxides of chromium, yttrium, tantalum, with a secondary emission coefficient of $\delta_{max} \leqq 3.5$ and an electrical sheet resistance of at least $10^{12}$ Ω/□.

We claim:

1. A picture display device comprising:

a. a vacuum envelope with a transparent face plate, supporting a display screen having a pattern of luminescent pixels, and a rear wall;

b. an electron producer contained within the envelope for producing electrons:

c. an addressing system arranged between said electron producer and the face plate so as to address desired pixels;

d. a spacer plate of electrically insulating material disposed adjacent the screen and including a multiplicity of apertures for passing electrons from the addressing system to the screen, and wherein surfaces of the spacer plate are coated with a coating comprising a material selected from the group consisting of nitrides, borides, carbides, and oxides of yttrium and tantalum.

2. A display device as claimed in claim 1, wherein the coating is provided from a suspension by means of a spraying process, a dipping process or a curtain-spraying process.

3. A display device as claimed in claim 1 wherein the coating is provided by means of a phototacky process.

4. A display device as claimed in claim 1, wherein the coating comprises a material selected from the group consisting of silicon nitride and aluminum nitride.

5. A display device as claimed in claim 1, wherein the coating comprises $Y_2O_3$.

6. A display device as claimed in claim 1, wherein the coating has a particle character.

7. A display device as claimed in claim 1, wherein the spacer plate comprises a material having an electrical resistance R (in Ωcm) which complies with log $R \geqq 10$.

8. A display device as claimed in claim 1, wherein the coating is provided from a suspension by means of a spraying process, a dipping process, or a curtain-spraying process.

9. A display device as claimed in claim 1, wherein the coating is provided by means of a phototacky process.

10. A picture display device comprising:

a. a vacuum envelope with a transparent face plate, supporting a display screen having a pattern of luminescent pixels, and a rear wall;

b. an electron producer contained within the envelope for producing electrons;

c. an addressing system arranged between said electron producer and the face plate so as to address desired pixels;

d. a spacer plate of electrically insulating material disposed adjacent the screen and including a multiplicity of apertures for passing electrons from the addressing system to the screen, wherein surfaces of the spacer plate are coated with a coating comprising a material selected from the group consisting of nitrides, oxynitrides and metal oxides and having a secondary emission coefficient $(\delta_{max}) \leqq 3.5$ and an electrical resistance greater than $10^{12}$ Ω/□.

11. A display device as claimed in claim 10, wherein the coating comprises a material selected from the group consisting of silicon nitride and aluminum nitride.

12. A display device as claimed in claim 10, wherein the coating comprises $Y_2O_3$.

13. A display device as claimed in claim 10, wherein the spacer plate consists essentially of a material having an electrical resistance R (in Ωcm) which complies with log $R \geqq 10$.

14. A display device as claimed in claim 10, wherein the coating has a secondary emission coefficient which is less than 3 and an electrical resistance which is greater than $10^{12}$ Ω/□.

15. A display device as claimed in claim 10, wherein the coating has a secondary emission coefficient which is less than 3 and has an electrical resistance which is greater than $10^{13}$ Ω/□.

* * * * *